US008186011B2

(12) United States Patent
Rooney

(10) Patent No.: US 8,186,011 B2
(45) Date of Patent: May 29, 2012

(54) ADJUSTABLE DOOR STOP

(76) Inventor: Stephen J. Rooney, Naples, FL (US)

( * ) Notice: Subject to any disclaimer, the term of this patent is extended or adjusted under 35 U.S.C. 154(b) by 371 days.

(21) Appl. No.: 12/489,220

(22) Filed: Jun. 22, 2009

(65) Prior Publication Data

US 2010/0319160 A1 Dec. 23, 2010

(51) Int. Cl.
*E05F 5/02* (2006.01)

(52) U.S. Cl. ..... 16/82; 16/86 A

(58) Field of Classification Search ..... 16/82, 86 A, 16/DIG. 17; 292/338, 339, 342, 343, DIG. 15, 292/DIG. 60

See application file for complete search history.

(56) References Cited

U.S. PATENT DOCUMENTS

| | | | | | |
|---|---|---|---|---|---|
| 384,715 | A | * | 6/1888 | Reisse | 292/338 |
| 790,653 | A | * | 5/1905 | Notthoff | 254/39 |
| 842,691 | A | * | 1/1907 | Palmer | 292/338 |
| 855,961 | A | * | 6/1907 | Merring | 292/338 |
| 1,473,834 | A | * | 11/1923 | Sasgen | 292/338 |
| 1,479,029 | A | * | 1/1924 | Dixon | 292/338 |
| 1,505,184 | A | * | 8/1924 | Zukor | 292/338 |
| 1,636,549 | A | * | 7/1927 | Brown | 292/338 |
| 2,964,780 | A | * | 12/1960 | Blankenship | 16/82 |
| 3,831,989 | A | | 8/1974 | Gurzenda | |
| 4,019,765 | A | * | 4/1977 | Nichola | 292/338 |
| 4,136,899 | A | * | 1/1979 | Frasher | 292/338 |
| 4,300,796 | A | * | 11/1981 | Lane | 292/339 |
| 4,395,065 | A | | 7/1983 | Nelson et al. | |
| 4,483,558 | A | * | 11/1984 | Van Meter | 292/339 |
| 4,514,000 | A | | 4/1985 | Chezem et al. | |
| 4,607,253 | A | * | 8/1986 | Wooten et al. | 340/546 |
| 4,673,203 | A | | 6/1987 | Chezem | |
| 4,819,296 | A | * | 4/1989 | Wilkins | 16/82 |
| 5,131,701 | A | * | 7/1992 | Stepniewski | 292/339 |
| 5,135,273 | A | * | 8/1992 | MacCalder | 292/338 |
| 5,207,464 | A | | 5/1993 | Reeves | |
| 5,282,658 | A | | 2/1994 | Reeves, Jr. | |
| 5,286,075 | A | * | 2/1994 | Monzingo | 292/339 |
| 5,340,175 | A | | 8/1994 | Wood | |
| 5,503,443 | A | * | 4/1996 | Tautfest | 292/339 |
| 5,673,952 | A | | 10/1997 | Chezem et al. | |
| 5,787,548 | A | * | 8/1998 | Tzen | 16/82 |

(Continued)

FOREIGN PATENT DOCUMENTS

| | | |
|---|---|---|
| GB | 789669 | 1/1958 |
| GB | 2347967 | 9/2000 |

*Primary Examiner* — Victor Batson
*Assistant Examiner* — Roberta Delisle
(74) *Attorney, Agent, or Firm* — Edward M. Livingston, Esq.; Bryan L. Loeffler, Esq.; The Livingston Firm

(57) ABSTRACT

An adjustable door stop (1) having a bracket (2), which may be mounted to the base of a door (3), and a tubular section (4) that may be pivotally or hingedly attached to the bracket so that the tubular section may be folded up into the bracket when the adjustable door stop is not in use and down when the adjustable door stop is in use. Clips (5) located on the bracket hold the tubular section in place while the tubular section is folded up into the bracket. An extendable rod (6) inserts into the tubular section and may be extended out of the tubular section to accommodate various heights of step downs or retracted into the tubular section when the tubular section is folded upward for storage. A lever (7) on the tubular section engages a series of ridges (8) located on the extendable rod to set the extendable rod to a desired length.

3 Claims, 1 Drawing Sheet

U.S. PATENT DOCUMENTS 6,347,817 B1 * 2/2002 Chou ..... 292/259 R
7,065,830 B2 6/2006 Bushey
7,164,356 B1 * 1/2007 Zeitz ..... 340/546
7,448,657 B2 11/2008 Blair

* cited by examiner

ADJUSTABLE DOOR STOP

BACKGROUND OF THE INVENTION

This invention relates to door stops, more particularly, a height adjustable door stop that may be adjusted to accommodate the step down from the threshold of a door to a surface beneath the threshold.

Door stops are used to prop doors open and prevent doors from closing. Currently, door stops are available that attach to the base of a door and fold down. A problem with these and other types of door stops is that they do not accommodate doors which have high thresholds or large step downs from the base of the door frame to a surface, such as a step. For example, if a door opens onto a porch that is six inches below the threshold of the door then a user would need a longer than average door stop to prop the door open. Although, door stops are available that are long enough to accommodate larger step downs, these door stops are aesthetically unpleasing when mounted to the base of a door due to their large size.

Therefore, a need exists for an adjustable door stop that is aesthetically pleasing and will accommodate a large range of heights between the threshold of a door and a surface.

The relevant prior art includes the following references:

| Pat. No. (U.S. unless stated otherwise) | Inventor | Issue/Publication Date |
|---|---|---|
| 7,448,657 | Blair | Nov. 11, 2008 |
| 7,065,830 | Bushey | Jun. 27, 2006 |
| GB2,347,967 | Gill | Sep. 20, 2000 |
| 5,673,952 | Chezem et al. | Oct. 07, 1997 |
| 5,282,658 | Reeves, Jr. | Feb. 01, 1994 |
| 5,340,175 | Wood | Aug. 23, 1994 |
| 5,207,464 | Reeves | May 04, 1993 |
| 4,673,203 | Chezem | Jun. 16, 1987 |
| 4,514,000 | Chezem et al. | May 30, 1985 |
| 4,395,065 | Nelson et al. | Jul. 26, 1983 |
| 3,831,989 | Gurzenda | Aug. 27, 1974 |
| GB789,669 | Kennington | Jan. 29, 1958 |

SUMMARY OF THE INVENTION

The primary object of the present invention is to provide an adjustable door stop that can accommodate a large range of step down heights.

Another object of the present invention is to provide an adjustable door stop that is compact when folded up and not in use.

An even further object of the present invention is to provide an adjustable door stop that is aesthetically pleasing when mounted on the base of a door.

The present invention fulfills the above and other objects by providing an adjustable door stop that mounts to the base of a door. The door stop comprises a bracket that is mounted to the base of a door and a tubular section that may be pivotally or hingedly attached to the bracket so that the tubular section may be folded up into the bracket when the door stop is not in use and down when the door stop is in use. Clips located on the bracket hold the tubular section in place while the tubular section is folded up into the bracket. An extendable rod inserts into the tubular section and may be extended out of the tubular section to accommodate various heights of step downs or retracted into the tubular section when the tubular section is folded upward for storage. A lever on the tubular section engages a series of ridges located on the extendable rod to lock the extendable rod in place when the extendable rod is extended and in use. A small protrusion is located on the bracket and comes into contact with the lever when the tubular section is folded upward into the bracket thereby disengaging the lever from the series of ridges located on the extendable rod allowing the extendable rod may be retracted into the tubular section. A cap, preferably made of rubber, is attached to the extendable rod and provides traction between the door stop and the floor.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF THE DRAWINGS

In the following detailed descriptions reference will be made to the attached drawings in which.

DESCRIPTION OF THE PREFERRED EMBODIMENTS

Figure 1:
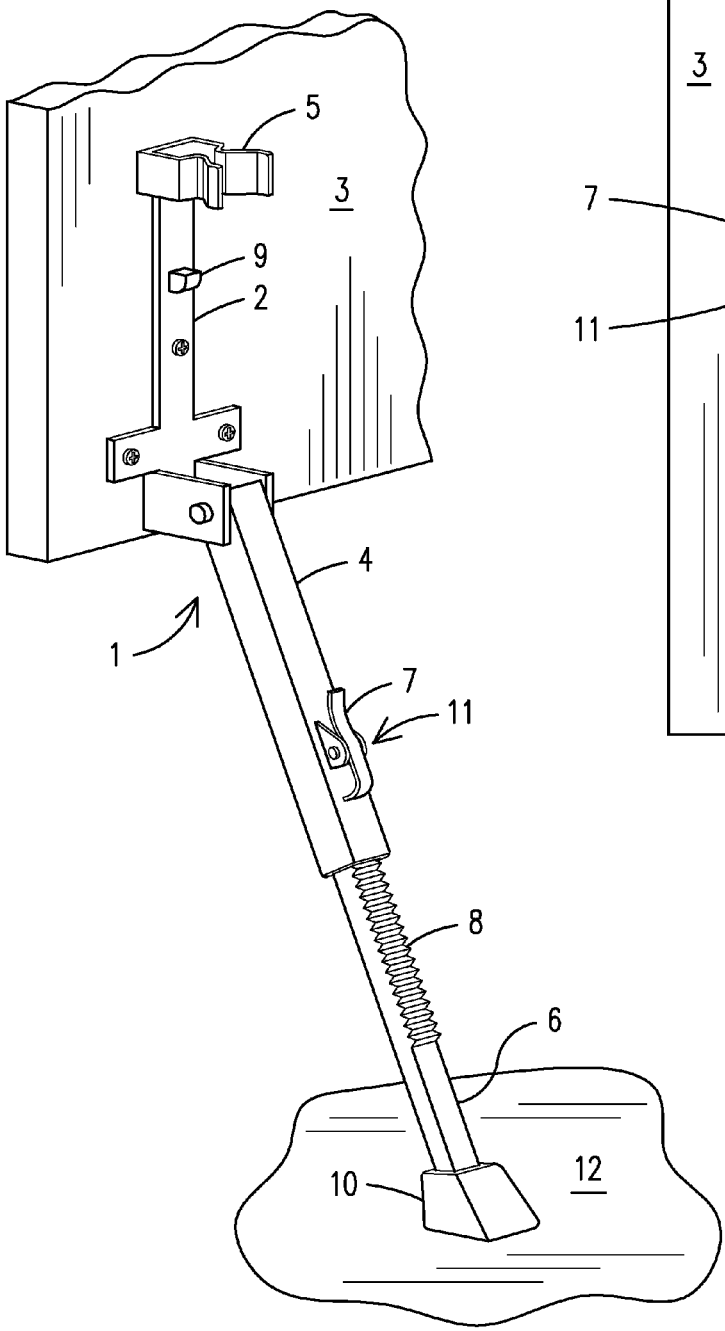
FIG. 1 is a front perspective view of an adjustable door stop of the present invention in an extended position.

For purposes of describing the preferred embodiment, the terminology used in reference to the numbered accessories in the drawings is as follows:

| | |
|---|---|
| 1. | adjustable door stop |
| 2. | bracket |
| 3. | door |
| 4. | tubular section |
| 5. | clips |
| 6. | extendable rod |
| 7. | lever |
| 8. | ridges |
| 9. | protrusion |
| 10. | cap |
| 11. | locking means |
| 12. | surface |

With reference to FIG. 1, a front perspective view of an adjustable door stop 1 of the present invention in an extended position is shown. The adjustable door stop 1 comprises a bracket 2 that may be mounted to the base of a door 3 and a tubular section 4 that may be pivotally or hingedly attached to the bracket 2 so that the tubular section 4 may be folded up into the bracket 2 when the adjustable door stop 1 is not in use and folded down when the adjustable door stop 1 is in use. Clips 5 located on the bracket 2 hold the tubular section 4 in place while the tubular section 4 is folded up into the bracket 2. An extendable rod 6 inserts into the tubular section 4 and may be extended out of the tubular section 4 to accommodate various heights of step downs or retracted into the tubular section 4 when the tubular section 4 is folded upward onto the bracket 2 for storage. A locking means 11, such as a lever 7 located on the tubular section 4 engages a series of ridges 8 located on the extendable rod 6 to lock the extendable rod 6 at a desired length when the extendable rod 6 is extended and in use. A small protrusion 9 is located on the bracket 2. A cap 10, preferably made of rubber, is attached to an end of the extendable rod 6 and provides traction between the adjustable door stop 1 and a surface 12, as shown in FIG. 2.

Figure 2:
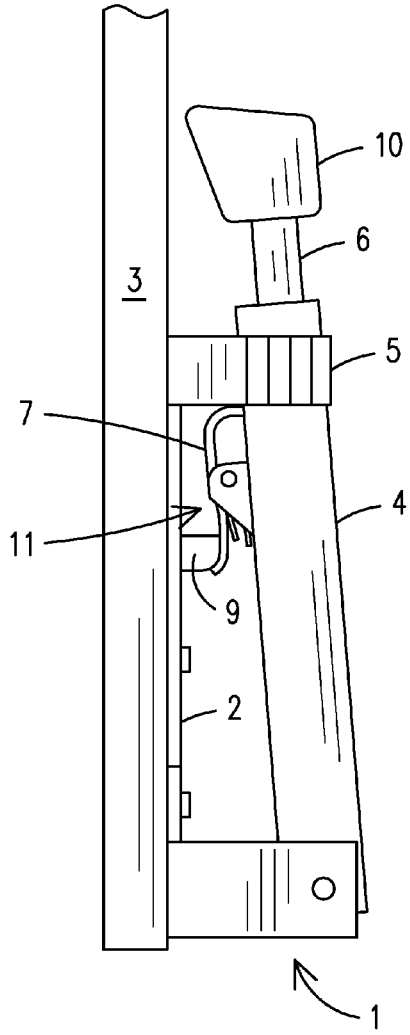
FIG. 2 is a side view of an adjustable door stop of the present invention in a folded position.

Now referring to FIG. 2, a side view of an adjustable door stop 1 of the present invention in a folded position. is shown. A bracket 2 having clips 5 that hold a tubular section 4 in place while the tubular section 4 is folded up into the bracket 2. An extendable rod 6 inserted into the tubular section 4 is retracted into the tubular section 4 when the tubular section 4 is folded upward onto the bracket 2 for storage. A locking means 11, such as a lever 7 located on the tubular section 4, engages a series of ridges 8 located on the extendable rod 6 to lock the extendable rod 6 in place when the extendable rod 6 is extended and in use, as shown in FIG. 1. A small protrusion 9 is located on the bracket 2 and comes into contact with the lever 7 when the tubular section 4 is folded upward into the bracket 2 thereby disengaging the lever 7 from the series of ridges 8 located on the extendable rod 6 so that the extendable rod 6 may be retracted into the tubular section 4. A cap 10, preferably made of rubber, is attached to an end of the extendable rod 6 and provides traction between the adjustable door stop 1 and a surface 12.

It is to be understood that while a preferred embodiment of the invention is illustrated, it is not to be limited to the specific form or arrangement of parts herein described and shown. It will be apparent to those skilled in the art that various changes may be made without departing from the scope of the invention and the invention is not be considered limited to what is shown and described in the specification and drawings.

Having thus described my invention, I claim:

1. An adjustable door stop comprising:

a bracket;

a tubular section pivotally attached to the bracket;

an extendable rod housed in the tubular section;

a locking means located on the tubular section that allows a user to set the extendable rod at a desired length;

said locking means is a lever;

at least one ridge located on the extendable rod that engages the lever; and a protrusion on the bracket that presses against the lever when the adjustable door stop is in a folded position, thereby disengaging the lever from the at least one ridge.

2. The adjustable door stop of claim 1 further comprising:

at least one clip that holds the tubular section and extendable rod in a folded position.

3. The adjustable door stop of claim 1 further comprising:

a cap attached to an end of the extendable rod.

* * * * *